US010012384B2

(12) United States Patent
Prichard et al.

(10) Patent No.: US 10,012,384 B2
(45) Date of Patent: Jul. 3, 2018

(54) GAS FLOW CONTROLLER INCLUDING OVER-PRESSURE PROTECTION FEATURES

(71) Applicant: Emerson Electric Co., St. Louis, MO (US)

(72) Inventors: James B. Prichard, Dardenne Prairie, MO (US); Donald L. Blessing, Manchester, MO (US); Mark H. Stark, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 450 days.

(21) Appl. No.: 14/880,200

(22) Filed: Oct. 10, 2015

(65) Prior Publication Data

US 2017/0102144 A1 Apr. 13, 2017

(51) Int. Cl.

| | |
|---|---|
| ***F23Q 9/00*** | (2006.01) |
| ***F23N 1/00*** | (2006.01) |
| ***F23D 14/02*** | (2006.01) |
| ***F23D 23/00*** | (2006.01) |

(52) U.S. Cl.
CPC ..... *F23N 1/002* (2013.01); *F23D 14/02* (2013.01); *F23D 23/00* (2013.01)

(58) Field of Classification Search
CPC ..... F23N 1/002; F23N 1/007; F15B 13/0405; Y10T 137/877; F16K 31/385; F16K 17/10; F16K 11/22; F16K 17/025; F16K 17/048; F16K 31/365; F16K 17/18; F16K 31/126
See application file for complete search history.

(56) References Cited

U.S. PATENT DOCUMENTS

| | | | |
|---|---|---|---|
| 5,209,253 | A | 5/1993 | Taylor |
| 6,182,944 | B1 | 2/2001 | Veronese et al. |
| 6,745,725 | B2 | 6/2004 | Toniolo et al. |
| 7,044,023 | B2 | 5/2006 | Toniolo et al. |
| 7,066,203 | B2 | 6/2006 | Baarda |
| 8,479,759 | B2 | 7/2013 | Benvenuto et al. |
| 2010/0122733 | A1 | 5/2010 | Grygus et al. |
| 2012/0153200 | A1 | 6/2012 | Turrin et al. |
| 2012/0160186 | A1 | 6/2012 | Turrin |

*Primary Examiner* — Jason Lau
(74) *Attorney, Agent, or Firm* — Armstrong Teasdale LLP

(57) ABSTRACT

A gas flow controller for use in a gas-fired apparatus including a pilot burner and a main burner is provided. The controller includes a housing defining a diaphragm chamber, a pilot valve operable to open and close a first fluid flow path between a gas supply inlet of the gas flow controller and the diaphragm chamber, and a main burner valve operable to open and close a second fluid flow path between the gas supply inlet and the main burner. The main burner valve includes a diaphragm that is disposed within the diaphragm chamber and includes a central portion and an annular outer portion. The outer portion is configured to deflect into engagement with the housing to close a third fluid flow path in response to an over-pressure condition at the gas supply inlet.

24 Claims, 7 Drawing Sheets

GAS FLOW CONTROLLER INCLUDING OVER-PRESSURE PROTECTION FEATURES

FIELD

The field of the disclosure relates generally to gas-fired apparatus, and more particularly, to gas flow controllers for use in gas-fired apparatus.

BACKGROUND

Gas-fired apparatus, such as residential gas-fired water heaters, often include a main gas burner to provide heat for the apparatus, and a pilot burner that provides a standing pilot flame to ignite the main gas burner (e.g., for the first time or if the main burner flame goes out). In the case of water heaters, a main gas burner is used to heat water within a water tank of the water heater. A thermostat is typically provided to control the temperature of the water inside the tank and typically may be set within a particular range (e.g., warm, hot or very hot). A pilot burner provides a standing pilot flame to ignite the main gas burner. To ignite the pilot flame in typical gas-fired apparatus, a user holds a pilot valve open (e.g., with a depressible knob) to permit gas to flow to the pilot burner, and ignites the gas at the pilot burner with an ignition source, such as an electronic igniter or a match.

At least some known gas flow controllers include flow regulators (e.g., servo-regulated valves) to regulate a flow of gas to the pilot burner and/or the main burner. Operation of such flow regulators may be impaired if the components of the flow regulators are exposed to pressures exceeding defined operating pressures, or "over-pressure conditions". In some instances, exposure to over-pressure conditions may damage components of the flow regulators, requiring repair or replacement.

At least some known gas flow controllers do not provide sufficient protection of components (e.g., servo-regulated valves) from over-pressure conditions. For example, some gas flow controllers permit gas flow along flow paths including flow regulators under abnormal operating conditions, such as an elevated or over-pressure condition at the inlet or upstream side of the pilot valve. This may result in excessive gas flow to the pilot burner, and may expose components of the gas flow controller to excessive pressures, impairing operation and/or damaging such components.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a gas flow controller for use in a gas-fired apparatus including a pilot burner and a main burner is provided. The controller includes a housing defining a diaphragm chamber, a pilot valve operable to open and close a first fluid flow path between a gas supply inlet of the gas flow controller and the diaphragm chamber, and a main burner valve operable to open and close a second fluid flow path between the gas supply inlet and the main burner. The main burner valve includes a diaphragm that is disposed within the diaphragm chamber and includes a central portion and an annular outer portion. The outer portion is configured to deflect into engagement with the housing to close a third fluid flow path in response to an over-pressure condition at the gas supply inlet.

In another aspect, a gas flow controller for use in a gas-fired apparatus including a pilot burner and a main burner is provided. The controller includes a housing, a pilot valve, and a main burner valve. The housing defines a diaphragm chamber and a plurality of fluid flow paths providing fluid flow out of the diaphragm chamber. The plurality of fluid flow paths include a main burner flow path and at least one servo-regulated flow path. The pilot valve is operable to open and close a primary fluid flow path providing fluid communication between a gas supply inlet and the diaphragm chamber. The main burner valve includes a diaphragm disposed within the diaphragm chamber. The diaphragm includes a central portion and an annular outer portion, and is moveable within the diaphragm chamber between an open position and a closed position in which the central portion seals against the housing to seal the main burner flow path. The outer portion deflects towards and into sealing engagement with the housing to seal the at least one servo-regulated flow path in response to an over-pressure condition at the gas supply inlet.

In yet another aspect, a gas flow controller for use in a gas-fired apparatus including a pilot burner and a main burner is provided. The controller includes a housing, a pilot valve, a first fluid flow regulator, a second fluid flow regulator, and a main burner valve. The housing defines a valve seat, a diaphragm chamber, a primary fluid flow path providing fluid communication between a gas supply inlet and the diaphragm chamber, and a plurality of fluid flow paths providing fluid flow out of the diaphragm chamber. The plurality of fluid flow paths includes a main burner flow path, a pilot burner flow path, and a valve regulating flow path. The pilot valve is operable to open and close the primary fluid flow path. The first fluid flow regulator is disposed in the pilot burner flow path for controlling a flow rate of gas to the pilot burner. The second fluid flow regulator is disposed in the valve regulating flow path for controlling a flow rate of gas to the main burner. The main burner valve includes a diaphragm disposed within the diaphragm chamber. The diaphragm includes a raised central portion and an annular outer portion, and is moveable within the diaphragm chamber between an open position and a closed position in which the central portion seals against the valve seat to seal the main burner flow path. The outer portion deflects into sealing engagement with the housing to seal the pilot burner flow path and the valve regulating flow path in response to an over-pressure condition at the gas supply inlet.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Figure 1:
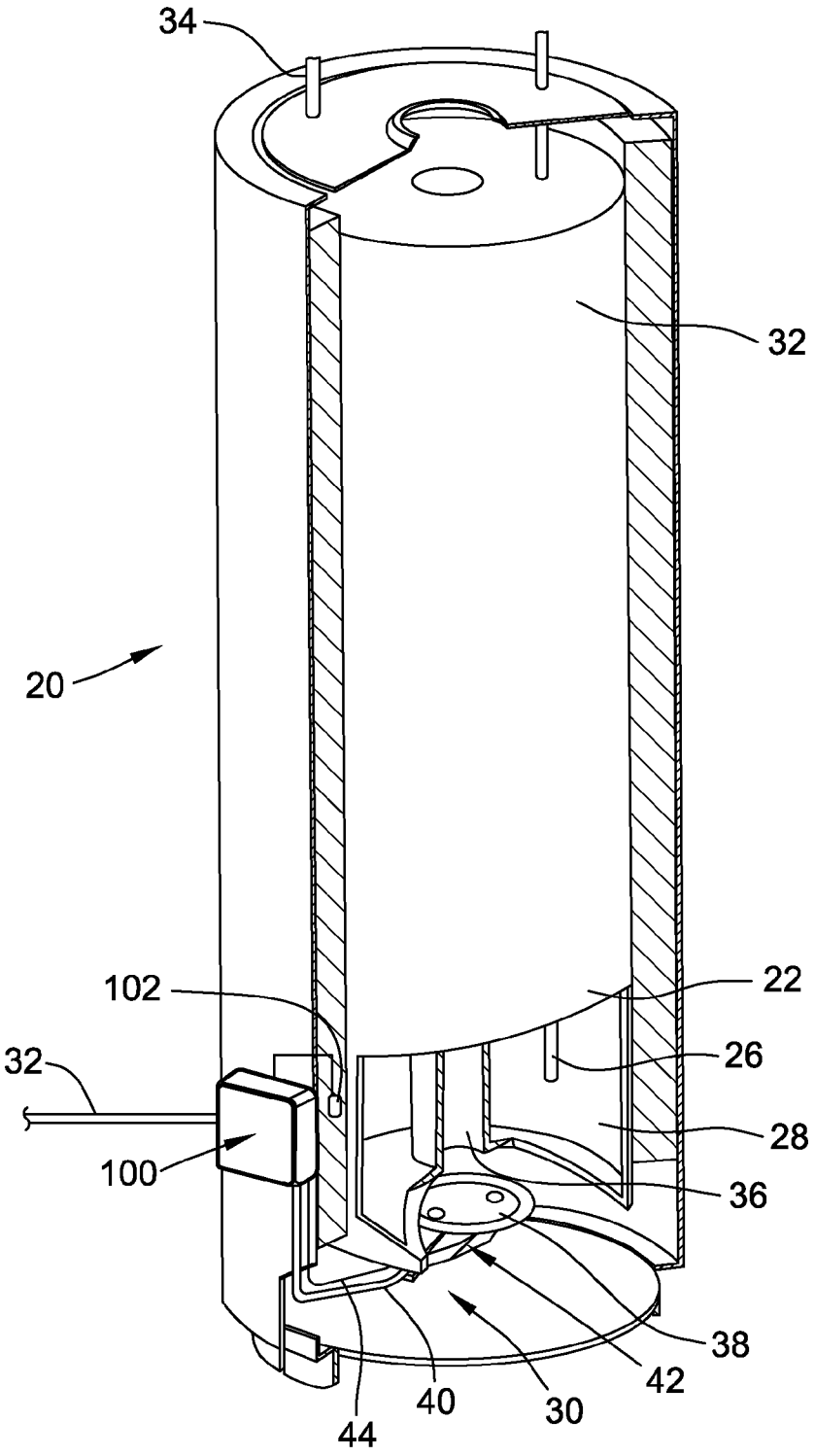
FIG. 1 is a cut-away view of a gas-fired apparatus shown in the form of a water heater system, the water heater system including a gas flow controller for controlling the supply of gas in the water heater system.

Referring to FIG. 1, a gas-fired apparatus illustrated in the form of a water heater system for heating and storing water is indicated generally at 20. Water heater system 20 generally includes a storage tank 22, a gas-fired burner assembly 30 positioned beneath storage tank 22 for heating water supplied to and stored in storage tank 22, and a controller 100 for controlling the supply of gas to main burner assembly 30. Storage tank 22 receives cold water via a cold water inlet 26 in a bottom portion 28 of storage tank 22. Cold water entering bottom portion 28 of storage tank 22 is heated by burner assembly 30. Water that is heated leaves storage tank 22 via a hot water outlet pipe 34. Combustion gases from burner assembly 30 leave water heater system 20 via a flue 36.

Controller 100 is connected to a gas supply (not shown) via a main gas supply line 32. Controller 100 is configured to control the supply of gas from main gas supply line 32 to burner assembly 30, as described in more detail herein.

Burner assembly 30 includes a main burner 38 connected to controller 100 via a gas supply line 40, and a pilot burner 42 for igniting main burner 38. Pilot burner 42 is also configured to detect whether a pilot flame is present or extinguished as further described herein, and communicate with controller 100 via connection 44 to control the supply of gas to main burner 38 (e.g., by shutting off the supply of gas if no pilot flame is detected).

Figure 2:
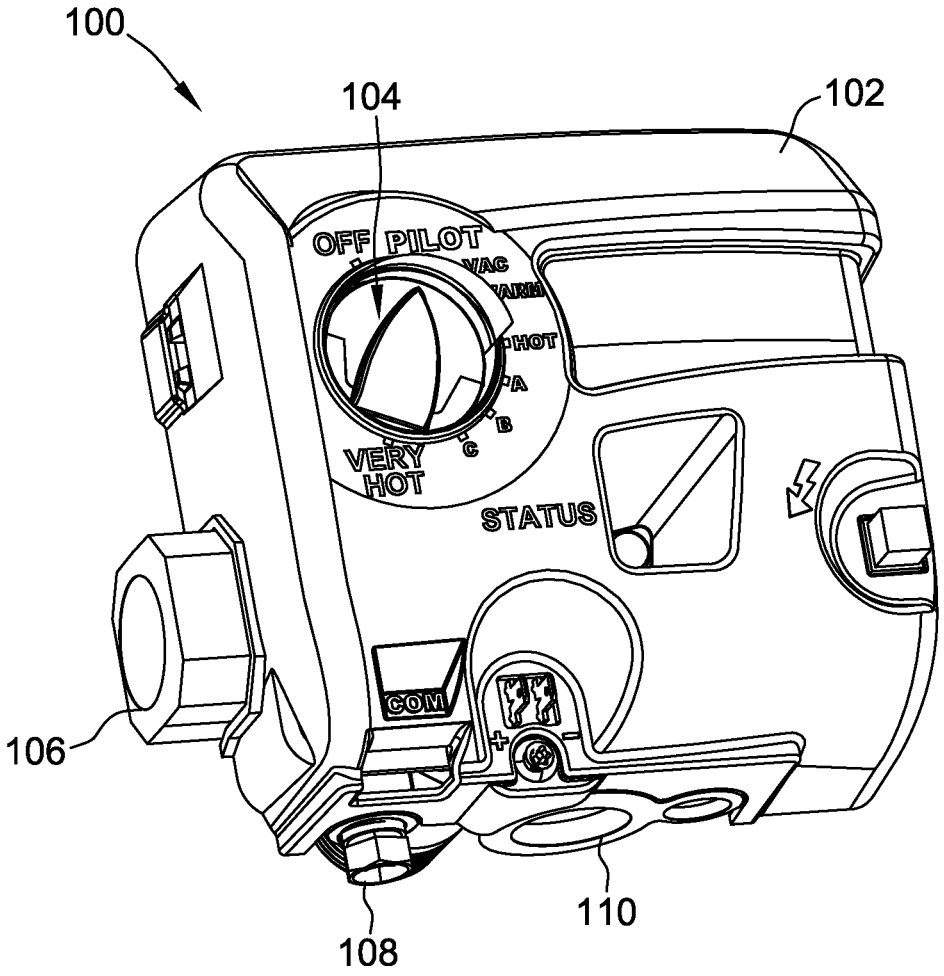
FIG. 2 is a perspective view of the controller shown in FIG. 1.
Figure 3:
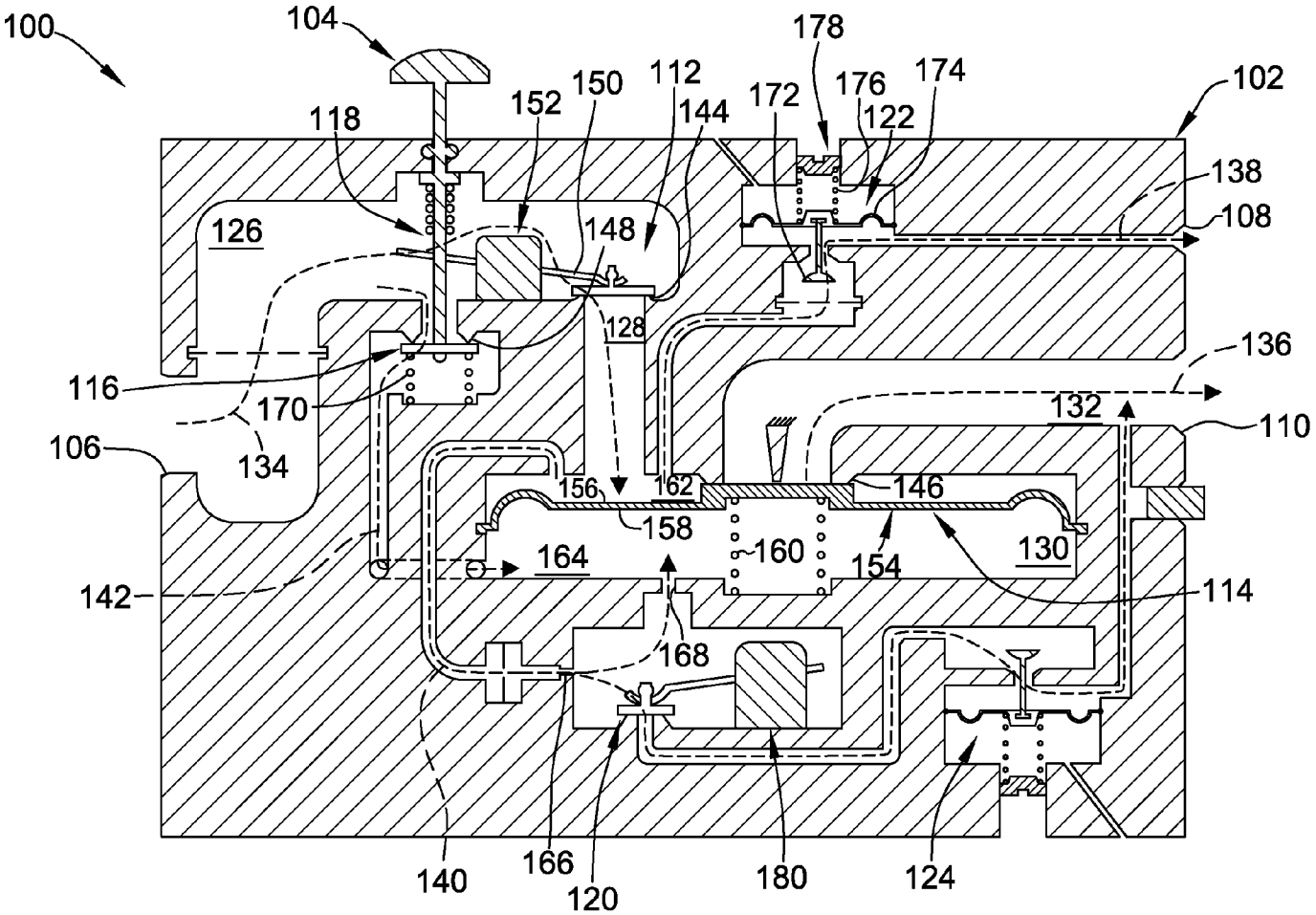
FIG. 3 is a schematic cross-section of the controller shown in FIG. 2, shown in an inactive or off state.

FIG. 2 is a perspective view of controller 100, and FIG. 3 is a schematic cross-section of controller 100. As shown in FIGS. 2 and 3, controller 100 includes a housing 102, an input device 104, a gas supply inlet 106, a pilot burner outlet 108, a main burner outlet 110, a pilot valve 112 (broadly, a first valve), a main burner valve 114 (broadly, a second valve), a flow controller valve 116 (broadly, a third valve), and a decoupling mechanism 118. Controller 100 also includes a pressure control valve 120 configured to open and close main burner valve 114 by regulating a pressure differential across main burner valve 114. Controller 100 also includes a pilot burner flow regulator 122 and a main burner flow regulator 124 configured to control the flow rate of gas to the pilot burner 42 and main burner 38 (both shown in FIG. 1), respectively. Controller 100 may also include an electronic controller (not shown) configured to send and receive electronic signals to and from one or more electronic components of water heater system 20.

Figure 4:
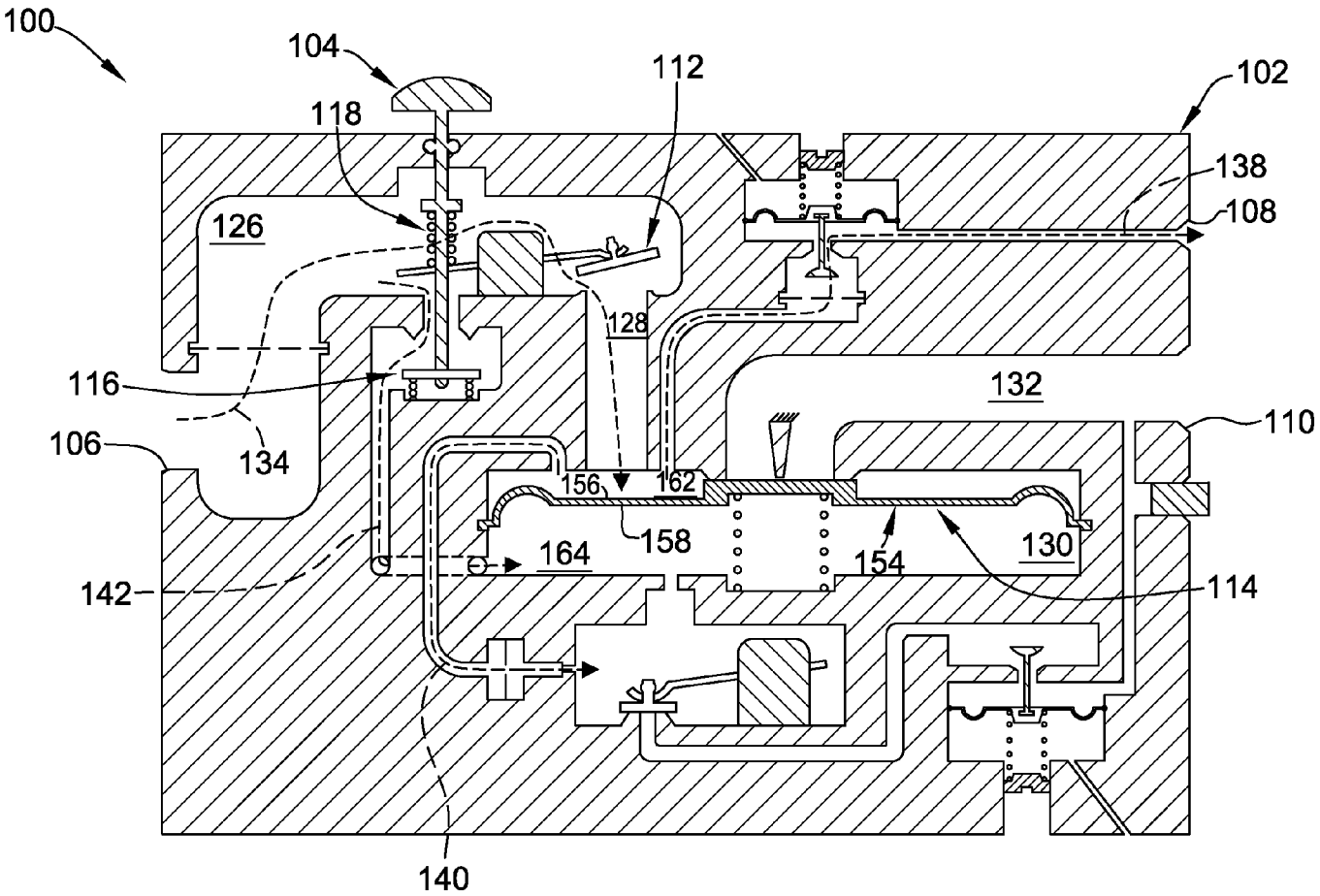
FIG. 4 shows the controller of FIG. 3 in a pilot ignition state under normal operating conditions.
Figure 5:
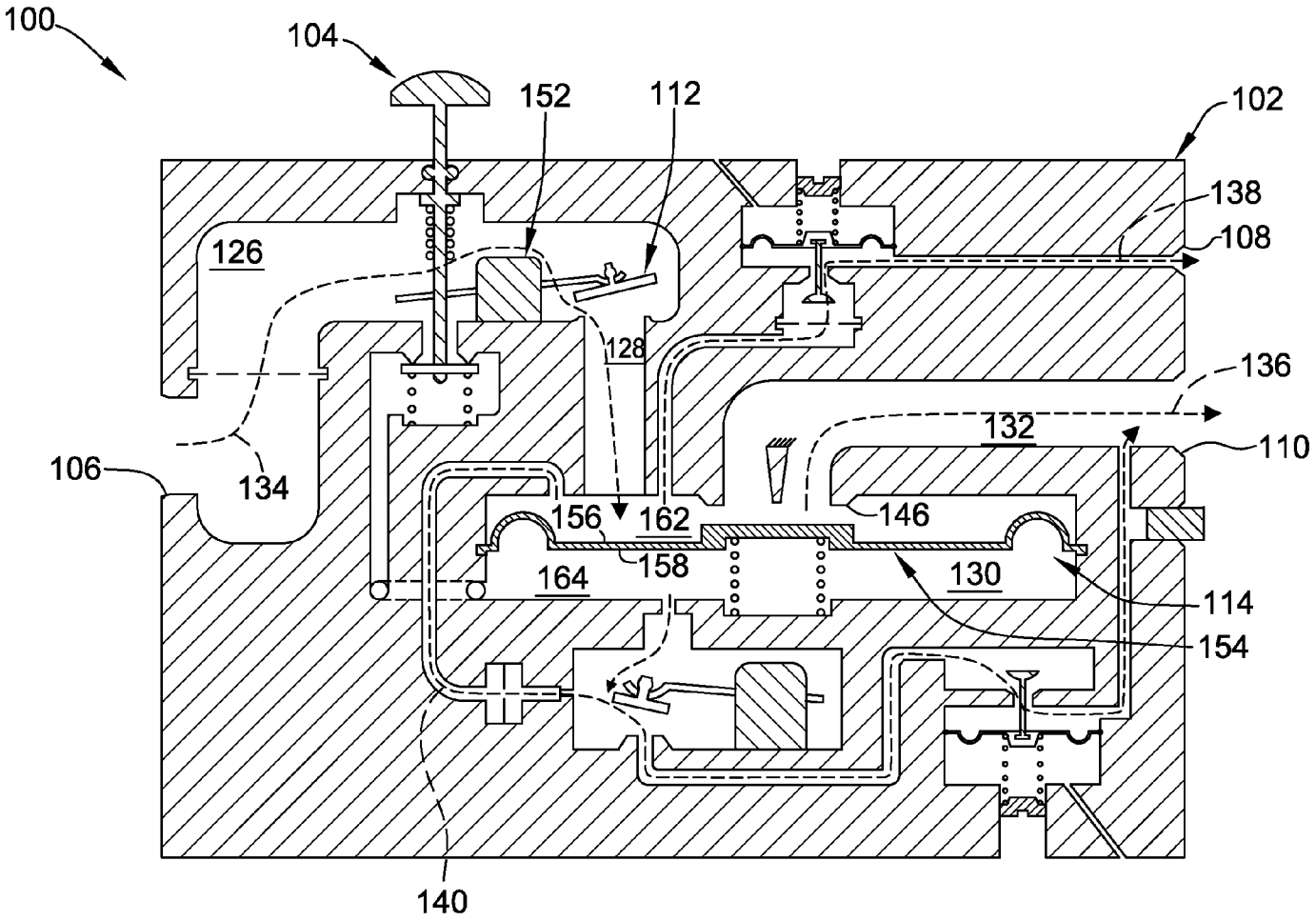
FIG. 5 shows the controller of FIG. 3 in a "main burner on" state.

In operation, controller 100 is used to control the supply of gas to pilot burner 42 and main burner 38 (both shown in FIG. 1) through pilot burner outlet 108 and main burner outlet 110, respectively, based on an operational state of controller 100. As described in more detail herein, the operational states of controller 100 include, for example, an off state, a pilot ignition state, a standby or "main burner off" state, and a "main burner on" state. FIG. 3 shows controller 100 in an off state, FIG. 4 shows controller 100 in a pilot ignition state under normal operating conditions (e.g., in the absence of an over-pressure condition), and FIG. 5 shows controller 100 in a "main burner on" state.

As shown in FIG. 3, housing 102 defines gas supply inlet 106, pilot burner outlet 108, and main burner outlet 110. Housing 102 also defines a plurality of fluid flow paths and chambers that fluidly connect gas supply inlet 106, pilot burner outlet 108, and main burner outlet 110 to one another. In the example embodiment, housing 102 defines a first fluid chamber 126, a second fluid chamber 128, a third fluid chamber 130, and a fourth fluid chamber 132. Third fluid chamber 130 is sized and shaped to receive a diaphragm therein, and is interchangeably referred to herein as a diaphragm chamber.

Housing 102 also defines a first or primary fluid flow path 134 providing fluid flow from gas supply inlet 106 to diaphragm chamber 130. Housing 102 also defines a main burner flow path 136 (broadly, a second fluid flow path) providing fluid flow from diaphragm chamber 130 to main burner outlet 110, and a pilot burner flow path 138 (broadly, a third fluid flow path) providing fluid flow from diaphragm chamber 130 to pilot burner outlet 108. Housing 102 further defines a valve regulating flow path 140 (broadly, a fourth fluid flow path) providing fluid flow out of and downstream from diaphragm chamber 130 to one or more flow regulating components. Housing 102 also defines a fifth fluid flow path 142 providing fluid flow from gas supply inlet 106 to a back side of main burner valve 114 and diaphragm chamber 130. A portion of housing 102 defining the fifth fluid flow path 142 is illustrated in broken lines in FIG. 3 to indicate that fifth fluid flow path 142 extends out of the plane in which the schematic cross-section is taken. Fifth fluid flow path 142 is illustrated in this way to indicate that fifth fluid flow path 142 does not intersect fourth fluid flow path 140 along the portion illustrated in broken lines.

Housing 102 also defines a first valve seat 144 configured to sealingly engage pilot valve 112 to inhibit gas flow from first fluid chamber 126 to second fluid chamber 128, a second valve seat 146 configured to sealingly engage main burner valve 114 to inhibit gas flow from gas supply inlet 106 to main burner outlet 110, and a third valve seat 148 configured to sealingly engage flow controller valve 116 to inhibit gas flow from first fluid chamber 126 to third fluid chamber 130.

Gas supply inlet 106 is configured to be connected to main gas supply line 32 (shown in FIG. 1), and to receive gas from main gas supply line 32. Pilot burner outlet 108 is configured to be fluidly connected to pilot burner 42 (shown in FIG. 1) to supply gas thereto. Main burner outlet 110 is configured to be fluidly connected to main burner 38 (shown in FIG. 1) to supply gas thereto.

Pilot valve 112 is configured to open and close primary fluid flow path 134 and to control the flow of gas from gas supply inlet 106 to pilot burner outlet 108. More specifically, pilot valve 112 is moveable between a closed position (shown in FIG. 3) in which pilot valve 112 sealingly engages first valve seat 144 and inhibits gas flow from gas supply inlet 106 to pilot burner outlet 108, and an open position (shown in FIG. 4), in which gas is permitted to flow from gas supply inlet 106 to pilot burner outlet 108.

Pilot valve 112 is operably connected to an interconnecting member 150 that is operable to open pilot valve 112 upon actuation of input device 104. Interconnecting member 150 is configured to pivot about a fulcrum (not shown in FIG. 3) to cause pilot valve 112 to open and close. Controller 100 may also include a pilot valve spring or biasing element (not shown in FIG. 3) configured to bias the pilot valve 112 towards the closed position.

Pilot valve 112 is also operably connected to a latch 152 configured to hold pilot valve 112 in an open position when a pilot flame is present at pilot burner 42. In one suitable embodiment, for example, an electronic controller (not shown) within controller 100 receives a signal from a thermo-electric device indicating the presence of a pilot flame at pilot burner 42, and the electronic controller transmits a signal to latch 152 to maintain pilot valve 112 in the open position. In the example embodiment, latch 152 includes an electromagnetic element configured to cooperate with a magnetic element within pilot valve 112 to maintain pilot valve 112 in an open position. In other suitable embodiments, latch 152 may have any suitable configuration that enables controller 100 to function as described herein.

Pilot valve 112 separates first fluid chamber 126 from second fluid chamber 128, and provides selective fluid communication between first fluid chamber 126 and second fluid chamber 128 by moving between the open position and the closed position. Pilot valve 112 also provides selective fluid communication between gas supply inlet 106, which is fluidly connected to first fluid chamber 126, and pilot burner outlet 108, which is fluidly connected to third fluid chamber 130. When pilot valve 112 is in the open position, gas supplied to gas supply inlet 106 (e.g., by main gas supply line 32, shown in FIG. 1) flows from gas supply inlet 106 along first fluid flow path 134 and third fluid flow path 138 to pilot burner outlet 108. Pilot valve 112 is operable to open and close first fluid flow path 134 by moving between the open and closed positions. Further, when pilot valve 112 is in the open position under normal operating conditions (shown in FIG. 4), gas supplied to gas supply inlet 106 is permitted to flow along fourth fluid flow path 140.

Main burner valve 114 is configured to control the flow of gas from gas supply inlet 106 to main burner 38 via main burner outlet 110. More specifically, main burner valve 114 is moveable between a closed position (shown in FIG. 3) in which main burner valve 114 inhibits gas flow from gas supply inlet 106 to main burner outlet 110, and an open position (shown in FIG. 5), in which gas is permitted to flow from gas supply inlet 106 to main burner outlet 110.

As shown in FIG. 3, main burner valve 114 includes a valve member shown in form of a flexible diaphragm 154. Diaphragm 154 is disposed within diaphragm chamber 130, and is configured to move between a closed position (shown in FIG. 3) to inhibit gas flow to main burner 38 and an open position (shown in FIG. 5) to permit gas flow to main burner 38. Diaphragm 154 includes a front side 156 and an opposing back side 158. Front side 156 is configured to sealingly engage second valve seat 146 defined by housing 102 to inhibit gas flow from gas supply inlet 106 to main burner outlet 110. Main burner valve 114 may be opened and closed by regulating a pressure differential across front side 156 and back side 158 of diaphragm 154. Controller 100 also includes a main burner valve spring 160 (broadly, a biasing element) configured to bias diaphragm 154 towards the closed position. Main burner valve spring 160 engages back side 158 of diaphragm 154, and exerts a biasing force on back side 158 of diaphragm 154. Thus, main burner valve 114 (specifically, diaphragm 154) is actuated using only mechanical means (i.e., by regulating a pressure differential across diaphragm 154) without any direct-acting electronic actuators or components.

Diaphragm 154 separates diaphragm chamber 130 into a first portion 162 in fluid communication with front side 156 of diaphragm 154, and a second portion 164 in fluid communication with back side of diaphragm 154. First portion 162 and second portion 164 are fluidly isolated from one another by diaphragm 154, and fluidly connected to one another by fourth fluid flow path 140. The fluid flow path connecting first portion 162 and second portion 164 includes a first pressure regulating orifice 166 and a second pressure regulating orifice 168. First and second pressure regulating orifices 166 and 168 are configured to regulate a pressure on back side 158 of diaphragm 154 to facilitate opening and closing diaphragm 154.

Main burner valve 114 (specifically, diaphragm 154) also separates second fluid chamber 128 from fourth fluid chamber 132, and provides selective fluid communication between second fluid chamber 128 and fourth fluid chamber 132 by moving between the closed position and the open position. Main burner valve 114 also provides selective fluid communication between second fluid chamber 128 and main burner outlet 110, which is fluidly connected to fourth fluid chamber 132. When main burner valve 114 and pilot valve 112 are in the open position (shown in FIG. 5), gas supplied to gas supply inlet 106 flows from gas supply inlet 106 along first fluid flow path 134 and second fluid flow path 136 to main burner outlet 110. Main burner valve 114 (specifically, diaphragm 154) is operable to open and close second fluid flow path 136 by moving between the open and closed positions.

Flow controller valve 116 is configured to control the flow of gas from gas supply inlet 106 to back side 158 of diaphragm 154 through fifth fluid flow path 142 which provides inlet pressure gas directly to back side 158 of diaphragm 154. More specifically, flow controller valve 116 is moveable between an open position, in which gas is permitted to flow from gas supply inlet 106 through fifth fluid flow path 142 to back side 158 of diaphragm 154, and a closed position in which flow controller valve 116 inhibits gas flow through fifth fluid flow path 142 to back side 158 of diaphragm 154. As shown in FIG. 3, gas flow is still permitted to the back side 158 of main burner valve 114 along fourth fluid flow path 140 even when flow controller valve 116 is in the closed position. Controller 100 may also include a flow controller valve spring or biasing element 170 configured to bias flow controller valve 116 towards the closed position.

Flow controller valve 116 provides selective fluid communication between first fluid chamber 126 and second portion 164 of diaphragm chamber 130 by moving between the closed position (shown in FIG. 3) and the open position (shown in FIG. 4). Flow controller valve 116 also provides selective fluid communication between gas supply inlet 106, which is fluidly connected to first fluid chamber 126, and back side 158 of diaphragm 154, which is in fluid communication with second portion 164 of diaphragm chamber 130. When flow controller valve 116 is in the open position, gas supplied to gas supply inlet 106 flows from gas supply inlet 106 along fifth fluid flow path 142 to second portion 164 of diaphragm chamber 130. In other words, when flow controller valve 116 is open, inlet pressure gas is supplied to back side 158 of diaphragm 154 through fifth fluid flow path 142. Flow controller valve 116 is operable to open and close fifth fluid flow path 142 by moving between the open and closed positions.

Input device 104 is configured to receive an input from a user of controller 100, such as a desired water temperature of water stored within storage tank 22 (shown in FIG. 1). In some embodiments, for example, input device 104 includes a rotary device accessible from an exterior of housing 102 that enables a user to select one of a plurality of temperature setpoints that correspond to a desired temperature of water stored within storage tank 22 (shown in FIG. 1). Controller 100 is configured to control the supply of gas to main burner 38 (shown in FIG. 1) based at least in part on a user input received at input device 104.

In the illustrated embodiment, input device 104 is also an actuator configured to open both pilot valve 112 and flow controller valve 116. Accordingly, input device 104 is interchangeably referred to herein as an actuator or actuating device. In other embodiments, controller 100 may include an actuating device separate from input device 104 for opening pilot valve 112 and flow controller valve 116.

Input device 104 is configured to open and close pilot valve 112 and flow controller valve 116. More specifically, input device 104 is movable from a first position (shown in FIG. 3) to a second position (shown in FIG. 4) in which input device 104 is operably connected to pilot valve 112 and flow controller valve 116 to open pilot valve 112 and flow controller valve 116. In the illustrated embodiment, input device 104 is a manually actuated actuator. Specifically, input device 104 is depressible or movable (e.g., by a user) from the first position to the second position. In other embodiments, controller 100 may include an automated actuator (e.g., a solenoid) that is actuated in response to receiving an electrical signal to open or close pilot valve 112. Under normal operating conditions, input device 104 is configured to open both pilot valve 112 and flow controller valve 116 when input device 104 is actuated from the first position to the second position. Thus, when a user actuates input device 104 during a pilot ignition sequence, flow controller valve 116 is opened by actuation of input device 104, and permits inlet pressure gas to flow directly to back side 158 of diaphragm 154. Flow controller valve 116 and fifth fluid flow path 142 thereby facilitate maintaining main burner valve 114 (specifically, diaphragm 154) in the closed position, inhibiting gas flow to main burner 38 when a pilot flame is being lit, and reducing the risk of hazardous ignition conditions. As described in more detail herein, decoupling mechanism 118 is configured to selectively disconnect input device 104 from pilot valve 112 under certain conditions, such as elevated or over-pressure conditions on the upstream or inlet side of pilot valve 112, to prevent pilot valve 112 from opening.

In some embodiments, input device 104 may be keyed with housing 102 such that input device 104 is only depressible or movable when oriented in certain positions. Controller may also include an input device spring (broadly, a biasing element) that biases input device 104 towards the first position such that input device 104 does not exert an opening force on pilot valve 112 or flow controller valve 116 in the absence of an applied force.

Decoupling mechanism 118 operably connects input device 104 to pilot valve 112, and is configured to limit the amount of opening force that can be applied to pilot valve 112 via interconnecting member 150 when input device 104 is depressed by a user. More specifically, decoupling mechanism 118 is configured to selectively disconnect input device 104 from interconnecting member 150 and pilot valve 112 when input device 104 is actuated and a pressure differential across pilot valve 112 exceeds a threshold pressure limit. Thus, when input device 104 is actuated from the first position to the second position, and the pressure differential across pilot valve 112 exceeds the threshold pressure limit, decoupling mechanism 118 prevents pilot valve 112 from opening (i.e., pilot valve 112 remains in the closed position). Input device 104, flow controller valve 116, and decoupling mechanism 118 may have substantially the same construction and operate in substantially the same manner as the corresponding components described in U.S. patent application Ser. No. 14/725,528, filed May 29, 2015, the disclosure of which is hereby incorporated by reference in its entirety.

Pilot burner flow regulator 122 is disposed within third or pilot burner flow path 138 downstream from diaphragm chamber 130. Pilot burner flow regulator 122 is configured to control the flow rate of gas to pilot burner 42 along pilot burner flow path 138. In the illustrated embodiment, for example, pilot burner flow regulator 122 includes a poppet valve 172 connected to a flow regulator diaphragm 174, and a flow regulator spring 176 connected to flow regulator diaphragm 174. Gas flowing through third fluid flow path 138 exerts a pressure on a front side of flow regulator diaphragm 174, causing flow regulator diaphragm 174 to pull poppet valve 172 towards a closed position. As the fluid flow rate along third fluid flow path 138 increases, the pressure on a front side of flow regulator diaphragm 174 increases and causes flow regulator diaphragm 174 to pull poppet valve 172 towards a closed position, thereby restricting fluid flow along third fluid flow path 138. As the fluid flow rate along third fluid flow path 138 decreases, the pressure on the front side of flow regulator diaphragm 174 decreases, allowing poppet valve 172 to move towards an open position and permitting a greater fluid flow rate along third fluid flow path 138.

In some embodiments, pilot burner flow regulator 122 is an electronically-controlled regulator. For example, pilot burner flow regulator 122 may include a servo-regulated valve configured to control the flow rate of gas along pilot burner flow path 138 within a certain range or below a certain flow rate in response to signals received from an electronic controller. In the illustrated embodiment, for example, flow regulator spring 176 is operably connected to a servo-regulator 178. Servo-regulator 178 is configured to adjust the spring or biasing force exerted on flow regulator diaphragm 174 by flow regulator spring 176. Use of servo-regulators allows more precise regulation of flow rate and/or outlet pressure. In other embodiments, pilot burner flow regulator 122 may include electronically-controlled regulators other than servo-regulated valves.

Pressure control valve 120 is configured to open and close main burner valve 114 and, more specifically, diaphragm 154, by regulating a pressure differential across front side 156 and back side 158 of diaphragm 154. More specifically, pressure control valve 120 is configured to open and close the fluid flow path fluidly connecting first portion 162 of diaphragm chamber 130 to second portion 164 of diaphragm chamber 130, and thereby regulate a pressure differential across front side 156 and back side 158 of diaphragm 154. Pressure control valve 120 is operably connected to a pressure control valve actuator 180 configured to open and close pressure control valve 120. Pressure control valve actuator 180 may include, for example and without limitation, an electronic actuator configured to open and close pressure control valve 120 in response to signals received from an electronic controller within controller 100. For example, when controller 100 determines the water temperature of water stored within storage tank 22 (shown in FIG. 1) is below a threshold temperature (e.g., a userselected temperature setpoint), an electronic controller within controller 100 may send a signal to pressure control valve actuator 180 to open pressure control valve 120, thereby causing main burner valve 114 to open and allowing gas to flow to main burner 38. Pressure control valve actuator 180 may include any suitable actuator that enables controller 100 to function as described herein, including, for example and without limitation, a solenoid actuator.

Main burner flow regulator 124 is disposed within fourth fluid flow path 140 downstream from diaphragm chamber 130. Main burner flow regulator 124 is configured to control the flow rate of gas to main burner 38 (shown in FIG. 1) by controlling the extent to which main burner valve 114 is open. More specifically, main burner flow regulator 124 is configured to control the flow rate of gas along fourth fluid flow path 140, thereby controlling the rate of gas flow away from back side 158 of diaphragm 154 and the pressure on back side 158 of diaphragm 154. In the illustrated embodiment, main burner flow regulator 124 has substantially the same construction as pilot burner flow regulator 122, and controls the flow rate of gas along fourth fluid flow path 140 in substantially the same manner as pilot burner flow regulator 122 described above.

As noted above, in the example embodiment, third fluid flow path 138 and fourth fluid flow path 140 each include servo-regulated valves that control the flow rate of gas through the respective flow paths. Third fluid flow path 138 and fourth fluid flow path 140 are thus also referred to herein as servo-regulated flow paths.

Figure 6:
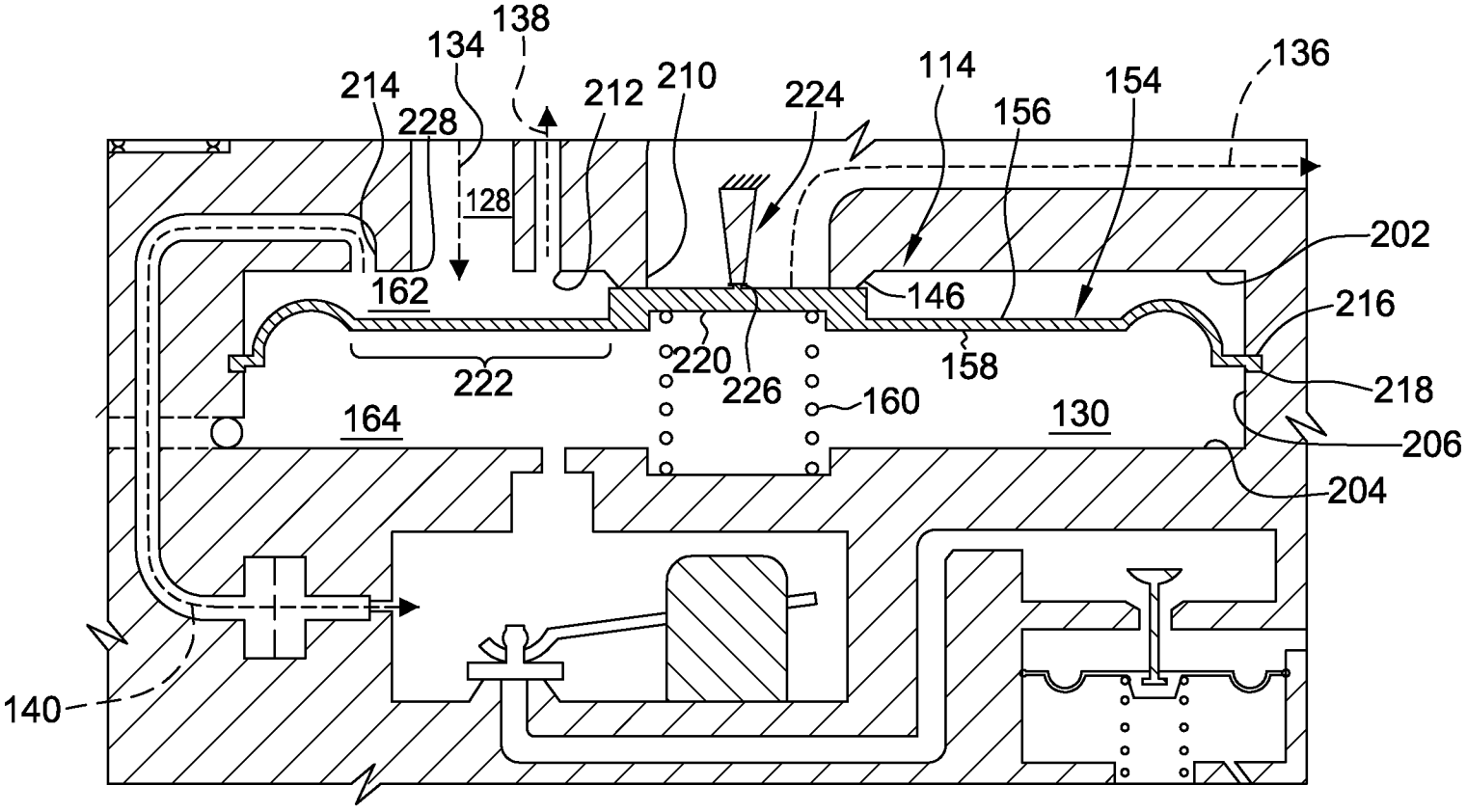
FIG. 6 is an enlarged view of a portion of the controller 100 shown in FIG. 3.

FIG. 6 is an enlarged view of a portion of controller 100 shown in FIG. 3, showing details of diaphragm chamber 130 and main burner valve 114. As shown in FIG. 6, diaphragm chamber 130 is defined by a first housing wall 202, a second housing wall 204 disposed opposite first housing wall 202, and an annular chamber sidewall 206 extending between first and second housing walls 202 and 204. A diaphragm inlet port 208 is defined in first housing wall 202 providing fluid flow into diaphragm chamber 130 from second fluid chamber 128 and first fluid flow path 134. Moreover, a plurality of diaphragm outlet ports are defined in first housing wall 202 that provide fluid flow out of diaphragm chamber 130 and into a corresponding fluid flow path. More specifically, the plurality of diaphragm outlet ports includes a first or main burner outlet port 210, a second or pilot burner outlet port 212, and a third outlet port 214.

Main burner outlet port 210 provides fluid flow out of diaphragm chamber 130 and downstream to main burner flow path 136 and main burner outlet 110. Pilot burner outlet port 212 provides fluid flow out of diaphragm chamber 130 and downstream to pilot burner flow path 138 and pilot burner outlet 108. Third outlet port 214 provides fluid flow out of diaphragm chamber 130 and downstream to fourth fluid flow path 140. Main burner outlet port 210 is located approximately centrally along first housing wall 202, and second and third outlet ports 212 and 214 are located radially inward and spaced from chamber sidewall 206.

Diaphragm 154 is disposed within diaphragm chamber 130, and is moveable within diaphragm chamber 130 between the closed position (shown in FIG. 6) and the open position (shown in FIG. 5). A circumferential edge 216 of diaphragm 154 is fixedly secured within an annular groove 218 defined in chamber sidewall 206 of housing 102.

Diaphragm 154 includes a raised, central portion 220 and an annular outer portion 222. Central portion 220 is configured to sealingly engage housing 102 (specifically, second valve seat 146) to seal main burner outlet port 210 and main burner flow path 136 when diaphragm 154 is in the closed position. As noted above, diaphragm 154 is opened and closed by regulating a pressure differential across diaphragm 154. Diaphragm 154 is configured to move from the open position to the closed position, in which central portion 220 seals main burner outlet 110 and main burner flow path, under a first pressure differential across diaphragm 154.

Outer portion 222 is configured to deflect towards and into sealing engagement with housing 102 adjacent second outlet port 212 and third outlet port 214 to seal second and third outlet ports 212 and 214 and their corresponding flow paths (i.e., pilot burner flow path 138 and fourth fluid flow path 140). More specifically, when diaphragm 154 is in the closed position and central portion 220 is seated against second valve seat 146, outer portion 222 is configured to deflect towards and into sealing engagement with first housing wall 202 in response to an elevated pressure differential between back side 158 and front side 156 of diaphragm 154. Thus, diaphragm 154 is configured to seal main burner flow path 136 under a first pressure differential across diaphragm 154 (e.g., during normal operation), and seal each of the pilot burner flow path 138 and fourth fluid flow path 140 under a second pressure differential greater than the first pressure differential (e.g., when an elevated or over-pressure condition exists at the inlet or upstream side of pilot valve 112). Diaphragm 154 thereby protects components of controller 100, such as electronic pressure and flow regulators (e.g., servo-regulated valves), by preventing such components from being exposed to over-pressure conditions. As used herein, the term "over-pressure condition" refers to a pressure that exceeds a pressure rating of the gas flow controller or manufacturer-specified operating pressures for the gas flow controller.

In the example embodiment, outer portion 222 is configured to seal both of second and third outlet ports 212 and 214, although in other embodiments, diaphragm 154 may only seal one of second outlet port 212 and third outlet port 214. Moreover, in the example embodiment, outer portion 222 of diaphragm 154 is further configured to seal diaphragm inlet port 208 by deflecting towards and sealingly engaging first housing wall 202 adjacent diaphragm inlet port 208. In other embodiments, diaphragm 154 may not be configured to seal diaphragm inlet port 208.

Diaphragm 154 has a suitably flexible construction that allows central portion 220 to translate towards and away from second valve seat 146, and outer portion 222 to deflect towards and into sealing engagement with housing 102 in response to an over-pressure condition at the upstream or inlet side of pilot valve 112. Moreover, outer portion 222 of diaphragm 154 is sufficiently flexible to enable outer portion 222 to conform to the shape of first housing wall 202 such that outer portion 222 can seal diaphragm outlet ports defined in first housing wall 202.

Diaphragm 154 may have any suitable construction that enables diaphragm 154 to function as described herein. For example, diaphragm 154 may be constructed from suitably flexible materials that enable translation of central portion 220 and deflection of outer portion 222 as described herein. Suitable materials from which diaphragm 154 may be constructed include, for example and without limitation, rubbers, such as natural rubber, silicone rubber, and nitrile rubber. Additionally or alternatively, diaphragm 154 may have areas of increased and/or decreased thickness to provide increased flexibility of diaphragm 154. In the illustrated embodiment, for example, annular outer portion 222 has a thickness less than a thickness of central portion 220 to provide more flexibility in outer portion 222 and allow outer portion to deflect towards and into engagement with housing 102.

Second and third outlet ports 212 and 214 are suitably sized and shaped to enable diaphragm 154 to seal the ports and corresponding downstream flow paths when an over-pressure condition exists at the upstream or inlet side of the pilot valve 112. In the illustrated embodiment, second and third outlet ports 212 and 214 each have a generally circular cross-section, although the outlet ports 212 and 214 may have cross-sections other than circular in other embodiments. Moreover, second and third outlet ports 212 and 214 are located radially inward and spaced from chamber side-wall 206 to allow outer portion 222 of diaphragm 154 to seal the ports when outer portion 222 deflects towards and into engagement with first housing wall 202 of diaphragm chamber 130. In some embodiments, second and third outlet ports 212 and 214 have a diameter in the range of about 0.015625 inches (1/64 inch) to about 0.125 inches (1/8 inch) and, more suitably, in the range of about 0.0625 inches (1/16 inch) to about 0.09375 inches (3/32 inch). Moreover, in some embodiments, second and third outlet ports 212 and 214 have cross-sectional areas between zero square inches ($in^2$) and about 0.012 $in^2$ and, more suitably, between about 0.003 $in^2$ and about 0.007 $in^2$.

In the illustrated embodiment, housing 102 further includes a diaphragm support or stop 224 located centrally within main burner outlet port 210. Stop 224 includes an upstream end 226 located flush with or downstream from second valve seat 146, and extends downstream from upstream end 226 into main burner flow path 136. Stop 224 is configured to engage central portion 220 of diaphragm 154 to prevent or inhibit central portion 220 from protruding through main burner outlet port 210 when an over-pressure condition exists at the upstream or inlet side of pilot valve 112.

In operation, controller 100 is used to control the supply of gas to pilot burner 42 and main burner 38 (both shown in FIG. 1) during different operational states of controller 100. As noted above, the operational states of controller 100 include, for example, an off state, a pilot ignition state, a standby state, and a "main burner on" state. In the pilot ignition state (shown in FIG. 4) controller 100 is used to safely ignite a pilot flame (e.g., for the first time or after the pilot flame has been extinguished). More specifically, in the pilot ignition state, pilot valve 112 is held open such that gas supplied by main gas supply line 32 (shown in FIG. 1) flows from gas supply inlet 106 along first fluid flow path 134 and third fluid flow path 138 to pilot burner outlet 108. Gas is supplied to pilot burner 42 (shown in FIG. 1) from pilot burner outlet 108, and is ignited by an igniter (not shown) included in pilot burner 42. Under normal operating conditions, main burner 38 is in the closed position during the pilot ignition state.

When a pilot flame is detected at pilot burner 42 (e.g., by a thermo-electric device, such as a thermopile), controller 100 enters the standby state. In the standby state, pilot valve 112 is held in the open position (e.g., by an electromagnetic latch) such that gas is continuously supplied to pilot burner 42 (shown in FIG. 1) through pilot burner outlet 108. More specifically, in the example embodiment, a thermo-electric device generates a signal to an electronic controller within controller 100 indicating the presence of a pilot flame at pilot burner 42 (shown in FIG. 1), and the electronic controller transmits a signal to an electromagnetic latch to hold pilot valve 112 in the open position. Moreover, main burner valve 114 is held in the closed position during the standby state such that gas flow to the main burner 38 is inhibited.

Controller 100 enters the "main burner on" state (shown in FIG. 5) when controller 100 receives a signal to ignite main burner 38 (shown in FIG. 1). Main burner valve 114 may be actuated by regulating a pressure differential across front side 156 and back side 158 of diaphragm 154 using pressure control valve 120, as described in more detail herein.

When controller 100 determines the supply of gas to main burner 38 should be shut off (e.g., by receiving a signal from a thermostat that a water temperature of water within storage tank 22 has reached a threshold temperature), main burner valve 114 is closed. Additional details of the standby and "main burner on" states of controller 100, and related functionality and components of controller 100, are described in more detail in U.S. patent application Ser. No. 14/276,507, filed on May 13, 2014, the entire disclosure of which is hereby incorporated by reference.

Under normal operating conditions, when input device 104 is actuated from the first position to the second position (shown in FIG. 4), pilot valve 112 is opened and gas is permitted to flow along third fluid flow path 138 to pilot burner outlet 108, and at least partially along fourth fluid flow path 140. As shown in FIG. 4, actuation of input device 104 from the first position to the second position also causes flow controller valve 116 to open, such that fifth fluid flow path 142 is open. Thus, under normal operating conditions, input device 104 is configured to open both pilot valve 112 and flow controller valve 116 when input device 104 is moved from the first position to the second position. As a result, gas supplied to gas supply inlet 106 is permitted to flow through fifth fluid flow path 142 into second portion 164 of diaphragm chamber 130 and to back side 158 of diaphragm 154. Fifth fluid flow path 142 is configured (e.g., size and shaped) to permit sufficient fluid flow to back side 158 of diaphragm 154 such that the resulting pressure on back side 158 of diaphragm 154 combined with the biasing force of main burner valve spring 160 is sufficient to maintain diaphragm 154 in the closed position, even under abnormal operating conditions. (e.g., where one or both of pressure regulating orifices 166 and 168 are blocked, or where pressure control valve 120 is open in the pilot ignition state). The configuration of flow controller valve 116 and fifth fluid flow path 142 thereby facilitates maintaining main burner valve 114 (specifically, diaphragm 154) in the closed position, and inhibiting gas flow to main burner 38 (shown in FIG. 1) when a pilot flame is being lit.

At least some previously used gas flow controllers permit gas flow along flow paths including flow regulators under abnormal operating conditions, such as elevated or over-pressure conditions at the inlet or upstream side of the pilot valve. This may result in excessive gas flow to the pilot burner, and may expose components of the gas flow controller to excessive pressures, impairing operation and/or damaging such components. Embodiments of gas flow controllers described herein overcome such drawbacks by providing diaphragm outlet ports having a reduced size and a flexible diaphragm configured to seal the diaphragm outlet ports when an over-pressure condition is present at the upstream or inlet side of the pilot valve.

Figure 7:
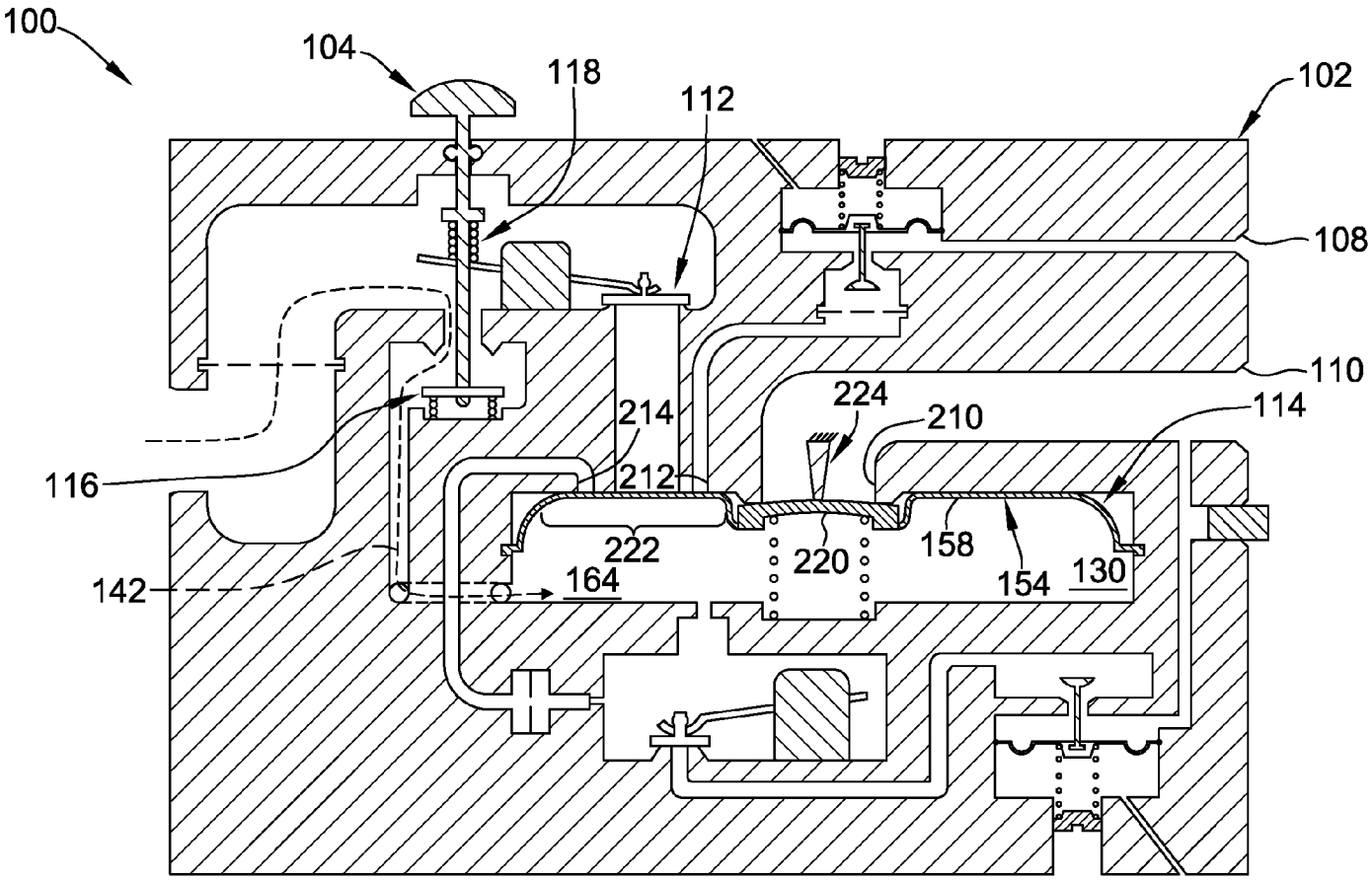
FIG. 7 shows the controller of FIG. 3 in an attempted pilot ignition state under abnormal operating conditions, such as an over-pressure condition.

FIG. 7 shows controller 100 in an attempted pilot ignition state under abnormal operating conditions. More specifically, FIG. 7 shows the controller 100 in a state in which an elevated or over-pressure condition exists on the upstream side of pilot valve 112, and the input device 104 is actuated in an attempt to light pilot burner 42.

As shown in FIG. 7, when input device 104 is actuated from the first position to the second position and an elevated or over-pressure condition exists on the upstream or inlet side of pilot valve 112, outer portion 222 of diaphragm 154 deflects towards housing 102 and conforms to housing 102 to seal diaphragm outlet ports 212 and 214. More specifically, when input device 104 is actuated from the first position to the second position, flow controller valve 116 is opened, and inlet pressure gas is supplied directly to back side 158 of diaphragm 154 via fifth fluid flow path 142. Consequently, when an over-pressure condition exists at inlet or upstream side of pilot valve 112, back side 158 of diaphragm 154 is exposed to the high pressure gas, causing outer portion 222 of diaphragm to deflect upwards and into sealing engagement with housing 102 to seal diaphragm outlet ports and corresponding downstream flow paths. Moreover, diaphragm stop 224 prevents or inhibits central portion 220 from protruding through main burner outlet port 210.

Additionally, in embodiments including decoupling mechanism 118, the decoupling mechanism 118 prevents pilot valve 112 from opening by operably disconnecting input device 104 from pilot valve 112, while still allowing flow controller valve 116 to be opened by actuation of input device 104.

Embodiments of the systems described herein achieve superior results as compared to prior art systems. For example, the gas flow controllers described herein include a flexible diaphragm configured to seal diaphragm outlet ports when an over-pressure condition is present at the upstream or inlet side of the pilot valve, thereby protecting downstream components from exposure to over-pressure conditions. In particular, the diaphragm includes an annular outer portion configured to deflect towards and into sealing engagement with portions of a housing adjacent the diaphragm outlet ports to prevent gas flow therethrough. Moreover, embodiments of gas flow controllers described herein include a diaphragm support or stop that prevents or inhibits damage to the diaphragm during an over-pressure condition. More specifically, the diaphragm support is located within a main burner outlet port and is configured to prevent or inhibit extrusion of the diaphragm through the main burner outlet port during an over-pressure condition.

Example embodiments of gas-fired appliances, such as water heater systems, and gas flow controllers for use in such gas-fired appliances are described above in detail. The system and controller are not limited to the specific embodiments described herein, but rather, components of the system and controller may be used independently and separately from other components described herein. For example, the gas flow controllers described herein may be used in gas-fired apparatus other than water heaters, including without limitation furnaces, dryers and fireplaces.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A gas flow controller for use in a gas-fired apparatus including a pilot burner and a main burner, the controller comprising:

a housing defining a valve seat, a diaphragm chamber, a primary fluid flow path providing fluid communication between a gas supply inlet and the diaphragm chamber, and a plurality of fluid flow paths providing fluid flow out of the diaphragm chamber, the plurality of fluid flow paths including a main burner flow path, a pilot burner flow path, and a valve regulating flow path;

a pilot valve operable to open and close the primary fluid flow path;

a first fluid flow regulator disposed in the pilot burner flow path for controlling a flow rate of gas to the pilot burner;

a second fluid flow regulator disposed in the valve regulating flow path for controlling a flow rate of gas to the main burner; and a main burner valve including a diaphragm disposed within the diaphragm chamber, the diaphragm including a raised central portion and an annular outer portion, the diaphragm moveable within the diaphragm chamber between an open position and a closed position in which the central portion seals against the valve seat to seal the main burner flow path, wherein the outer portion deflects into sealing engagement with the housing to seal the pilot burner flow path and the valve regulating flow path in response to an over-pressure condition at the gas supply inlet.

2. The gas flow controller of claim 1, wherein the diaphragm is configured to seal the main burner flow path at a first pressure differential across the diaphragm, and further seal at least one of the pilot burner flow path and the valve regulating flow path at a second pressure differential across the diaphragm greater than the first pressure differential.

3. The gas flow controller of claim 1, wherein the pilot valve is operably connected to an actuator, the pilot valve operable to open and close the primary fluid flow path upon actuation of the actuator, the gas flow controller further comprising a flow controller valve operably connected to the actuator and configured to open and close a fluid flow path between the gas supply inlet and a back side of the diaphragm upon actuation of the actuator.

4. The gas flow controller of claim 1, further comprising a diaphragm stop disposed within the main burner flow path for engagement with the raised central portion of the diaphragm.

5. A gas flow controller for use in a gas-fired apparatus including a pilot burner and a main burner, the controller comprising:

a housing defining a diaphragm chamber and a plurality of fluid flow paths providing fluid flow out of the diaphragm chamber, the plurality of fluid flow paths including a main burner flow path and at least one servo-regulated flow path;

a pilot valve operable to open and close a primary fluid flow path providing fluid communication between a gas supply inlet and the diaphragm chamber; and a main burner valve including a diaphragm disposed within the diaphragm chamber, the diaphragm including a central portion and an annular outer portion, the diaphragm moveable within the diaphragm chamber between an open position and a closed position in which the central portion seals against the housing to seal the main burner flow path, wherein the outer portion deflects towards and into sealing engagement with the housing to seal the at least one servo-regulated flow path in response to an over-pressure condition at the gas supply inlet.

6. The gas flow controller of claim 5, wherein the diaphragm is configured to seal the main burner flow path at a first pressure differential across the diaphragm, and further seal the at least one servo-regulated flow path at a second pressure differential across the diaphragm greater than the first pressure differential.

7. The gas flow controller of claim 5, wherein the pilot valve is operably connected to an actuator, the pilot valve operable to open and close the primary fluid flow path upon actuation of the actuator, the gas flow controller further comprising a flow controller valve operably connected to the actuator and configured to open and close a fluid flow path between the gas supply inlet and a back side of the diaphragm upon actuation of the actuator.

8. The gas flow controller of claim 5, wherein the annular outer portion has a thickness less than a thickness of the central portion.

9. The gas flow controller of claim 5, wherein the housing includes an annular chamber sidewall at least partially defining the diaphragm chamber, the housing further defining a diaphragm outlet port for the at least one servo-regulated flow path, wherein the diaphragm outlet port is spaced radially inward from the annular chamber sidewall.

10. The gas flow controller of claim 9, wherein the diaphragm outlet port has a circular opening with a diameter of between about 1/64 inch and about 1/8 inch.

11. The gas flow controller of claim 5, wherein the diaphragm includes a front side and an opposing back side, the front side disposed for engagement with the housing to seal the main burner flow path and the at least one servo-regulated flow path, wherein the gas flow controller further includes a spring disposed between the housing and the back side of the diaphragm to bias the diaphragm towards the closed position.

12. A gas flow controller for use in a gas-fired apparatus including a pilot burner and a main burner, the controller comprising:

a housing defining a diaphragm chamber;

a pilot valve operable to open and close a first fluid flow path between a gas supply inlet of the gas flow controller and the diaphragm chamber; and a main burner valve operable to open and close a second fluid flow path between the gas supply inlet and the main burner, the main burner valve including a diaphragm disposed within the diaphragm chamber and including a central portion and an annular outer portion, the outer portion configured to deflect into engagement with the housing to close a third fluid flow path in response to an over-pressure condition at the gas supply inlet.

13. The gas flow controller of claim 12, wherein the central portion is configured to seal the housing to close the second fluid flow path.

14. The gas flow controller of claim 12, wherein the pilot valve is operably connected to an actuator, the pilot valve operable to open and close the first fluid flow path upon actuation of the actuator, wherein the outer portion of the diaphragm is configured to close the third fluid flow path in response to the actuator being actuated while an over-pressure condition exists at the gas supply inlet.

15. The gas flow controller of claim 12, wherein the diaphragm is configured to close the second fluid flow path at a first pressure differential across the diaphragm, and close the third fluid flow path at a second pressure differential across the diaphragm greater than the first pressure differential.

16. The gas flow controller of claim 12, wherein the third fluid flow path is a servo-regulated flow path.

17. The gas flow controller of claim 12, further comprising a fluid flow regulator disposed in the third fluid flow path downstream from the diaphragm chamber, the fluid flow regulator configured to control a flow rate of gas through the third fluid flow path.

18. The gas flow controller of claim 17, wherein the fluid flow regulator is an electronically-controlled regulator.

19. The gas flow controller of claim 17, wherein the fluid flow regulator includes a servo-regulated valve.

20. The gas flow controller of claim 12, wherein the third fluid flow path provides fluid communication between the diaphragm chamber and the pilot burner.

21. The gas flow controller of claim 12, wherein the third fluid flow path provides fluid communication between a front side of the diaphragm and a back side of the diaphragm.

22. The gas flow controller of claim 12, wherein the annular outer portion is further configured to close a fourth fluid flow path in response to an over-pressure condition at the gas supply inlet, the fourth fluid flow path providing fluid flow out of the diaphragm chamber.

23. The gas flow controller of claim 12, wherein the housing further defines a fourth fluid flow path providing fluid communication between the gas supply inlet and a back side of the diaphragm.

24. The gas flow controller of claim 23, wherein the pilot valve is operably connected to an actuator, the pilot valve operable to open and close the first fluid flow path upon actuation of the actuator, the gas flow controller further comprising a flow controller valve operably connected to the actuator and configured to open and close the fourth fluid flow path.

* * * * *